US006561394B2

(12) United States Patent
Pripps et al.

(10) Patent No.: US 6,561,394 B2
(45) Date of Patent: May 13, 2003

(54) SHOULDER MOUNTED CHILD CARRIER

(76) Inventors: Steven Robert Pripps, 1007 E. Santan Dr., Gilbert, AZ (US) 85296; Donald Joseph Bolieau, 7534 Vardon Way, Fort Collins, CO (US) 80528

( * ) Notice: Subject to any disclaimer, the term of this patent is extended or adjusted under 35 U.S.C. 154(b) by 10 days.

(21) Appl. No.: 09/872,823

(22) Filed: Jun. 4, 2001

(65) Prior Publication Data

US 2002/0179654 A1 Dec. 5, 2002

(51) Int. Cl.[7] ..... A61G 1/00
(52) U.S. Cl. ..... 224/161; 224/159; 224/266
(58) Field of Search ..... 224/159, 160, 224/161, 158, 266

(56) References Cited

U.S. PATENT DOCUMENTS 3,698,608 A * 10/1972 Entwistle ..... 224/159
D294,429 S * 3/1988 Vasquez ..... D3/214
4,746,044 A * 5/1988 Arvizu et al. ..... 224/155
5,020,709 A * 6/1991 Hoaglan ..... 224/155
5,205,451 A * 4/1993 Manzer ..... 224/161
5,222,641 A * 6/1993 Medeiros, Jr. ..... 224/161
5,335,834 A * 8/1994 Verina ..... 224/159
5,509,590 A * 4/1996 Medeiros et al. ..... 224/161
6,098,856 A * 8/2000 Reilly ..... 224/159

* cited by examiner

*Primary Examiner*—Stephen K. Cronin

(57) ABSTRACT

The present invention provides a device designed to carry children in a chair like structure to be supported upon a carrier's shoulders. It is an improvement on previous shoulder mounted designs in that it is meant to be used by a lone person who may place the child in the seat, secure the child with straps and buckles, hoist the child and seat onto the shoulders, and secure the seat to the person by a second system of straps and buckles. It may also rest on any flat surface in a stable manner while the child is seated therein and indeed may double as a chair when not being used as a carrier.

7 Claims, 24 Drawing Sheets

Section I-I

Section II - II

SHOULDER MOUNTED CHILD CARRIER

CROSS REFERENCE TO RELATED APPLICATIONS

This patent application was previously submitted as a Disclosure Document, number 462912, on Sep. 28, 1999.

BACKGROUND OF THE INVENTION

1. Field of the Invention

The present Invention relates to a device that is mounted upon the shoulders of a person and is structured so that said person may carry another person therein. More specifically, the present Invention relates to a chair like shoulder mounted device for carrying small children.

2. Prior Art

There are several well-known methods for carrying a person, typically a child, upon the shoulders, back or front of a second person. Devices that position the child behind the back or to the front of the carrier have the disadvantage of creating a significant moment arm about the torso of the carrier, thus causing excess loads to be directed particularly to the waist and, through shoulder straps, to the shoulders. These loads allow the carrying of anyone much larger than a small infant practically impossible. Therefore, the ideal position for the center of gravity of the child should be directed as closely as possible over the vertical centerline of the carrier.

It is then considered that the ideal position for the load is upon the head of the carrier, and so it is that smaller loads are thus sometimes carried. However, the location above the head of the carrier creates another long moment arm about the center of support (the waist) and so, for all practical purposes, the ideal position for carrying any large load, and especially a child of any size, is upon the shoulders.

The preferred method should be structured so that the carried person is fastened securely to the device, which in turn is fastened securely to the carrier, thus freeing the arms and hands of the carrier from the encumbrance of providing support. Furthermore, to ensure the safety of the child, the preferred method would have the child fastened securely to the device before it is hoisted onto the shoulders of the carrier. The preferred method should also be easily mounted onto and dismounted from the carrier's shoulders, and the carrier should require no assistance in this task from a second person who would not always be available.

The devices shown in U.S. Pat. Nos. 3,968,910, 4,416,403 and 4,484,700 are all similar in one respect the carrying device must be mounted onto the carrier before the child is mounted upon the shoulders. If the carried person were to be secured into the device prior to mounting, it would then only be possible to mount the carrier from the back because the length of the framework prevents mounting the device from the front. This then assumes the assistance of a second person, if available, as it would be difficult if not impossible for the carrier to mount unaided the devices with a child secured therein.

The design described in U.S. Pat. No. 4,416,403 shows an arrangement wherein the empty device is mounted onto the carrier and the child lifted up and onto the carrier's shoulders. But there then remains the problem of fastening the retaining straps about the child, which the carrier must do blindly while at the same time restraining the child from falling, a difficult task at best, and in the worst case somewhat dangerous.

The design shown in U.S. Pat. No. 4,484,700 has as its sole method of retention a pair of straps for the child's feet, which allow the upper half of the child's body several degrees of freedom and occasion for discomfort as the child sways and rocks, alternately contacting the side rails, the back support and the back of the carrier's head.

The design shown in U.S. Pat. No. 3,968,910 has the same shortcomings as U.S. Pat. No. 4,484,700 but without even the use of the foot straps.

Whatever the merits, features and advantages of the above cited references, none of them achieves or fulfills the purposes of the present invention.

BRIEF SUMMARY OF THE INVENTION

The object of the present invention is four-fold: it is designed so that it supports a child comfortably upon the shoulders of the carrying person; its frame must be dimensioned so that the carrier may, without the assistance of a second person, mount it to the shoulders from a position in front of the carrier and dismount it in a like manner; it is secured to the carrier by a system of straps, buckles and/or locks; and it comfortably secures the carried person to the carrying device with a second system of straps and buckles. The present invention accomplishes all of these tasks concurrently.

BRIEF DESCRIPTION OF THE SEVERAL VIEWS OF THE DRAWING

FIG. 9 is a frontal isometric view showing the woven cloth seat/seat back for the child to sit in.

DETAILED DESCRIPTION OF THE INVENTION

Figure 1:
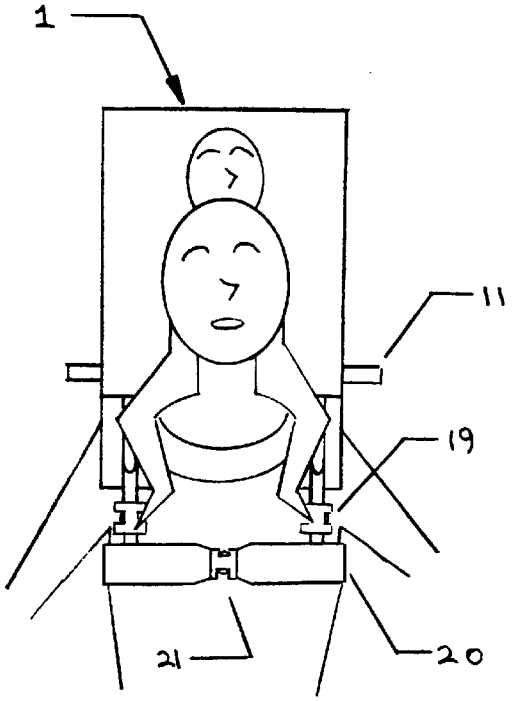
FIG. 1 is a frontal view of the carrying device shown mounted to the carrier with the child in the seat.
Figure 2:
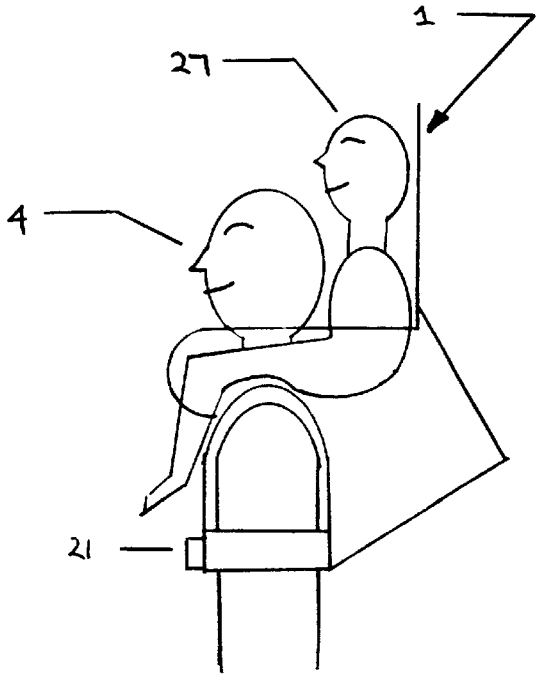
FIG. 2 is a side view of the carrying device shown mounted to the carrier with the child in the seat.

As shown in the drawings, the preferred shoulder mounted carrying device in accordance with the present invention, broadly denoted by the numeral 1, is comprised of an aluminum tubing and plate framework 2.

Figure 3:
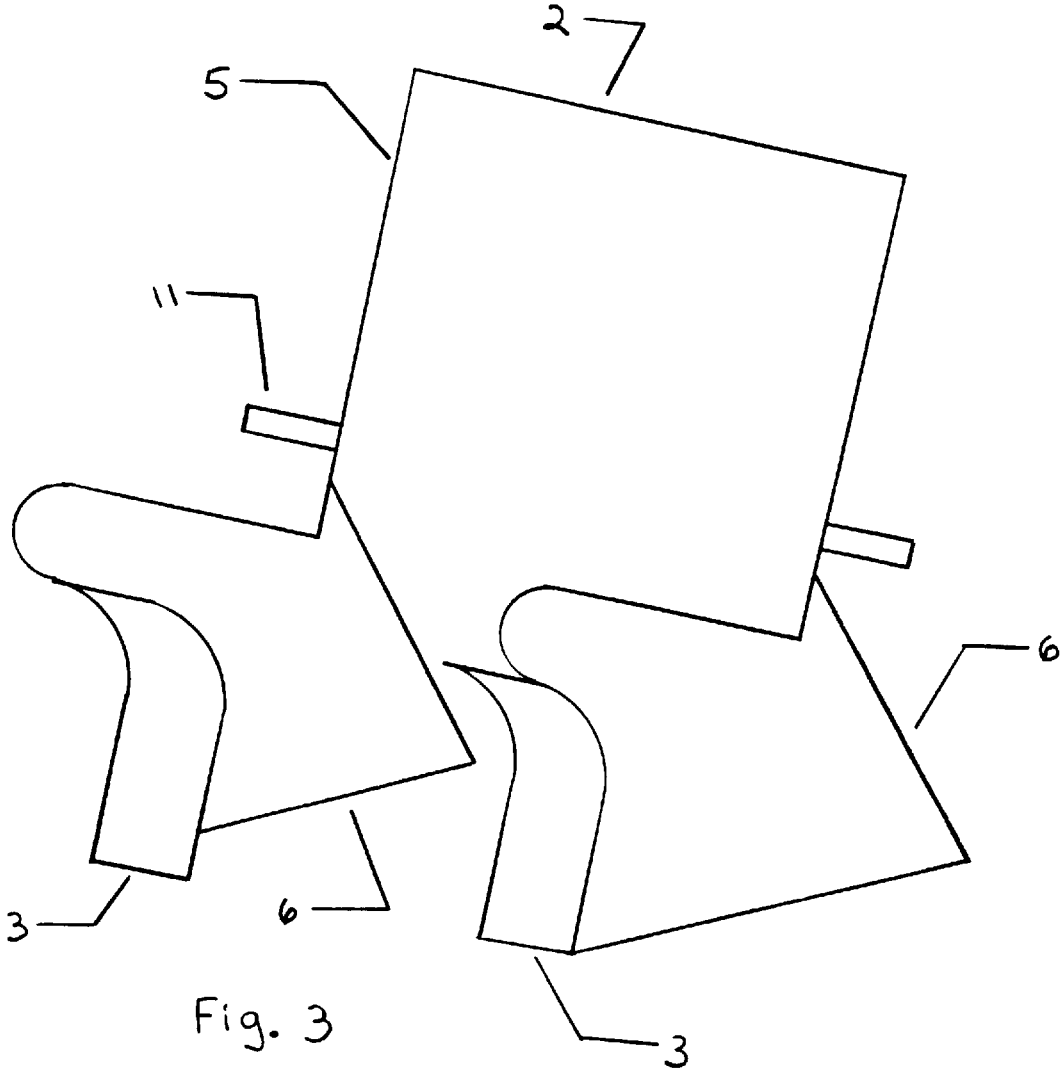
FIG. 3 is a frontal isometric view of the framework of the device shown at rest on a flat surface.
Figure 4:
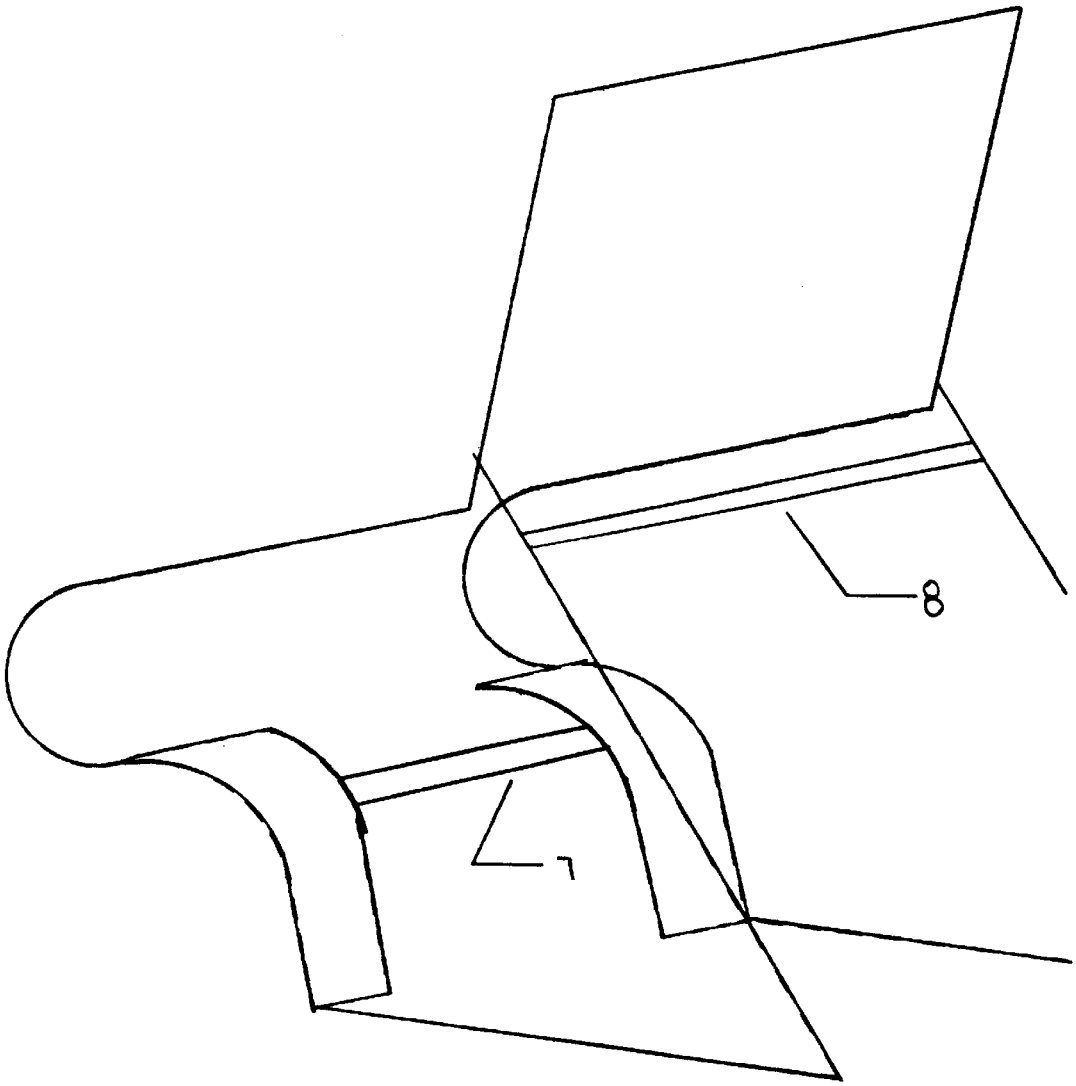
FIG. 4 is a back isometric view showing the lateral members.
Figure 5:
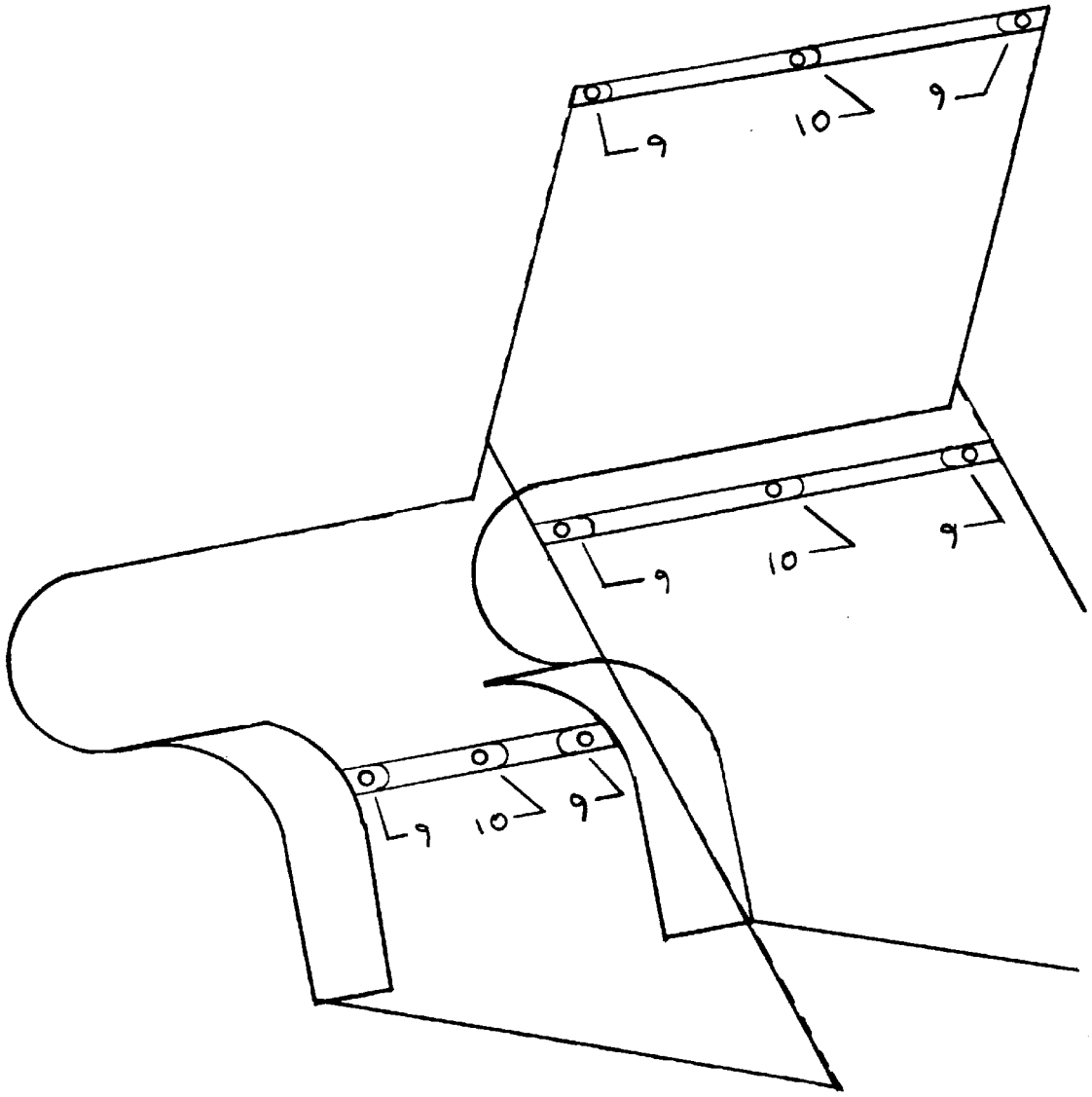
FIG. 5 is a back isometric view showing the lateral members with hinge points.

The framework 2 as shown in FIG. 3 is comprised of a pair of shoulder mount plates 3, the forward portion of which is formed into an arc so as to fit comfortably onto the shoulders of the carrier 4; an upper half member 5 comprised of a length of tubing which is symmetric about the halfway point and which at either end is connected to the upper outside corners of the shoulder mount plates 3, said tubing halves then being symmetrically formed in a semi-circular fashion to continue rearwardly, then symmetrically bent through 90 degree angles to continue upwardly, and then bent in opposing 90 degree angles so as to form the lateral upper portion of the back rest; and a pair of bottom half side members 6 which are connected to the bottom outside corner of the shoulder mount plates 3 to project rearwardly and which are then bent upward into an acute angle to connect to the upper half member 5. Lateral members 7 and 8 as shown in FIG. 4 (but not shown in FIG. 3 for purposes of clarity) connect the shoulder mount plates 3 and bottom half side members 6 respectively. As shown in FIG. 5 the two lateral members 7 and 8 and the lateral portion of the upper half member 5 may be hinged at either end by hinges 9 and about the center point by hinges 10 so that the carrying device may be folded for easy storage.

The handles 11 are positioned at the balance point of the loaded carrying device so that when lifted it rotates from its at rest position in a forward direction and may easily be placed upon the shoulders of the carrier. The handles may be affixed to the carrying device by welds or fasteners, or mounted on hinge points (not shown).

Figure 6:
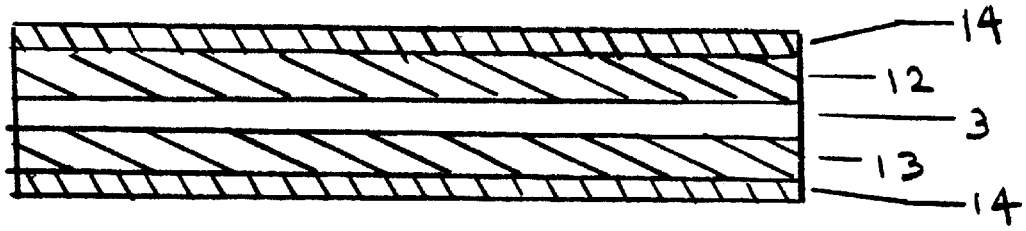
FIG. 6 is a cross sectional view detailing the padding and covering of the shoulder mounts.

As detailed in FIG. 6 which shows cross sectional view I—I, the shoulder mount plates 3 are covered by a top layer of foam padding 12, a bottom layer of foam padding 13 and a sewn envelope of woven nylon 14. Padding layers 12 and 13 are affixed to the shoulder plates 3 by means of adhesive.

The collar 15 is constructed of a single layer of foam padding (not shown) that is completely enclosed by a sewn envelope 17 of woven nylon and is connected at its either end to the forward portion of the two sewn envelopes 14 by means of sew joints.

Figure 7:
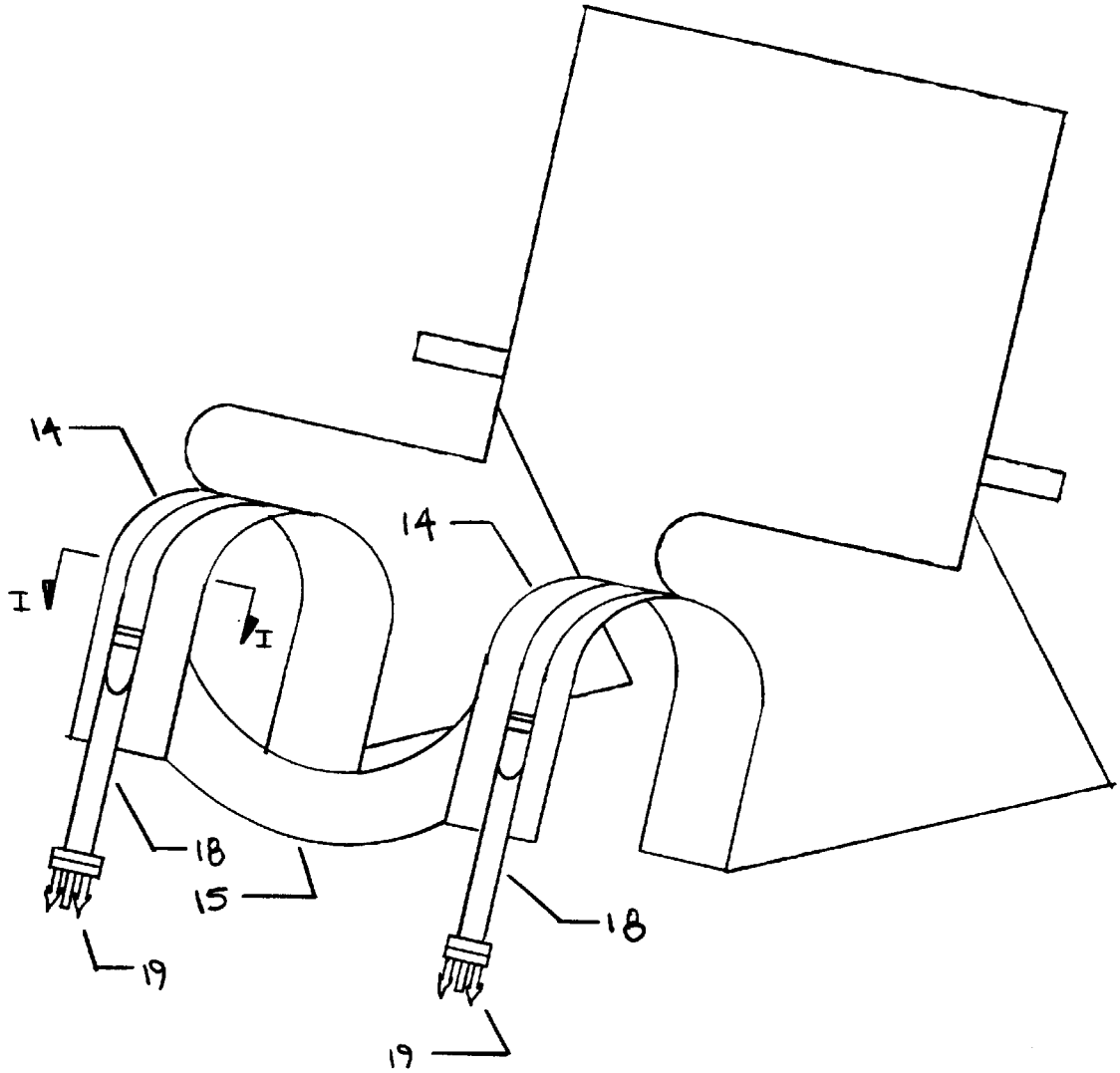
FIG. 7 is a frontal isometric view showing details of the collar and shoulder harness assembly.
Figure 8:
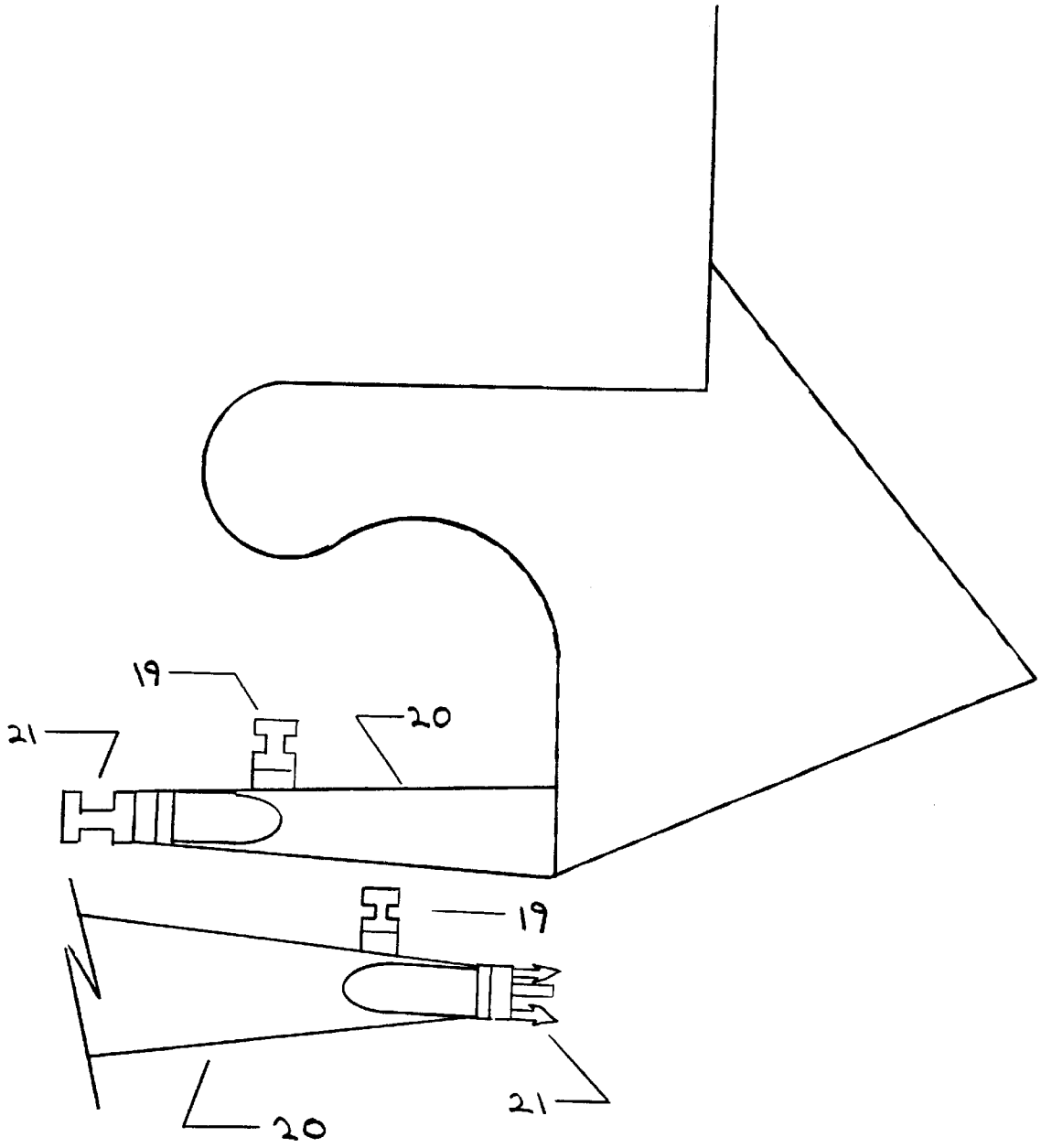
FIG. 8 is a side view showing the arrangement of the chest harness assembly with female end buckles for the shoulder harness assembly.

As shown in FIG. 7, each of the length adjustable shoulder harness assemblies 18 are connected at the one end to a sewn envelope 14 and at the other end to the male halves of buckles 19. The female halves of buckles 19 are sewn onto an opposing location of the chest harness assemblies 20 as shown in FIG. 8. Each of the chest harness assemblies are connected at the one end to the bottom portion of the shoulder mount plates and at the other looped through the male and female halves of buckle 21 respectively so as to be made length adjustable.

Figure 9:
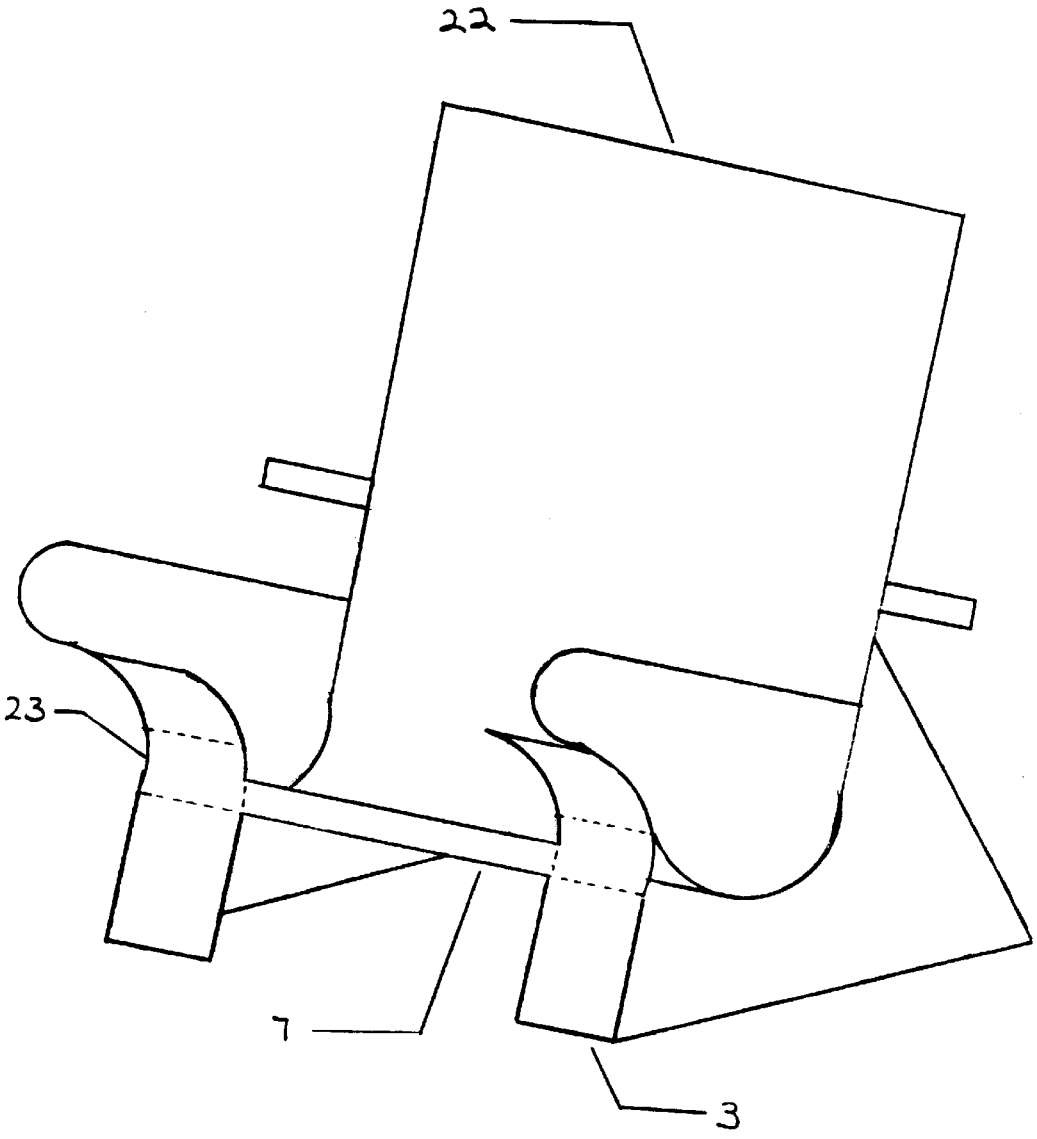

As shown in FIG. 9 the seat/seat back 22 is a single rectangular sheet of woven nylon which is looped over the upper lateral portion of upper half member 5 to be there affixed to itself by means of a sewn seam. The opposite end of the seat/seat back is likewise looped over lateral member 7 and there affixed to itself by a sewn seam. The corner portions 23 of the forward part of the seat/seat back are affixed to the rearward side of shoulder mount plates 3.

Figure 10:
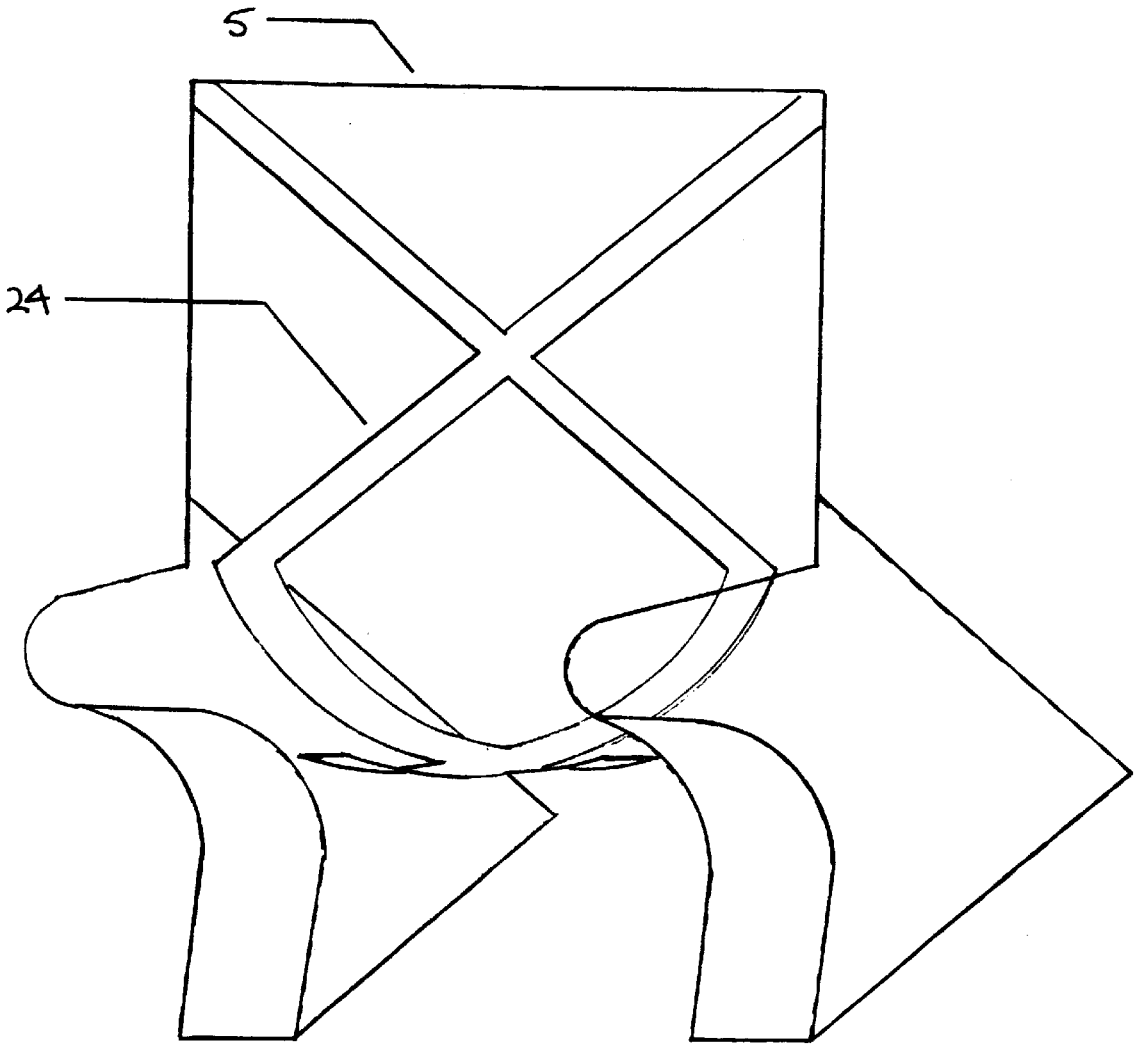
FIG. 10 is a frontal isometric view showing the alternate secondary support webbing of the seat.
Figure 11:
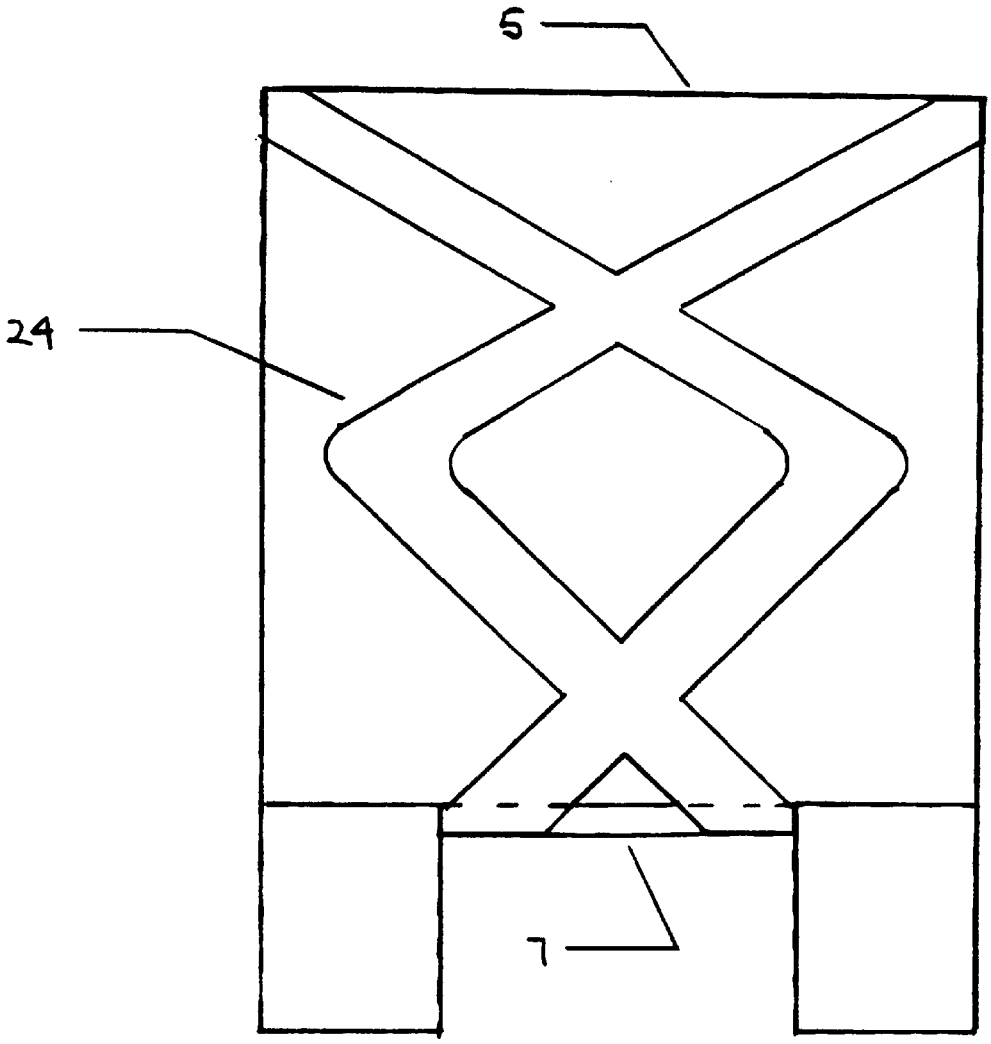
FIG. 11 is a plan view of the secondary support webbing.

The seat/seat back 22 is supported underneath by the support webbing 24, which is sewn onto its bottom side. The support webbing, as detailed separately in FIGS. 10 and 11, is comprised of two lengths of woven nylon which are arranged in a pair of "X" patterns behind the seat back and beneath the seat The upper and lower corners of the support webbing are connected to the upper lateral portion of the upper half member 5 and lateral member 7 (not shown in FIG. 10) respectively.

Figure 12:
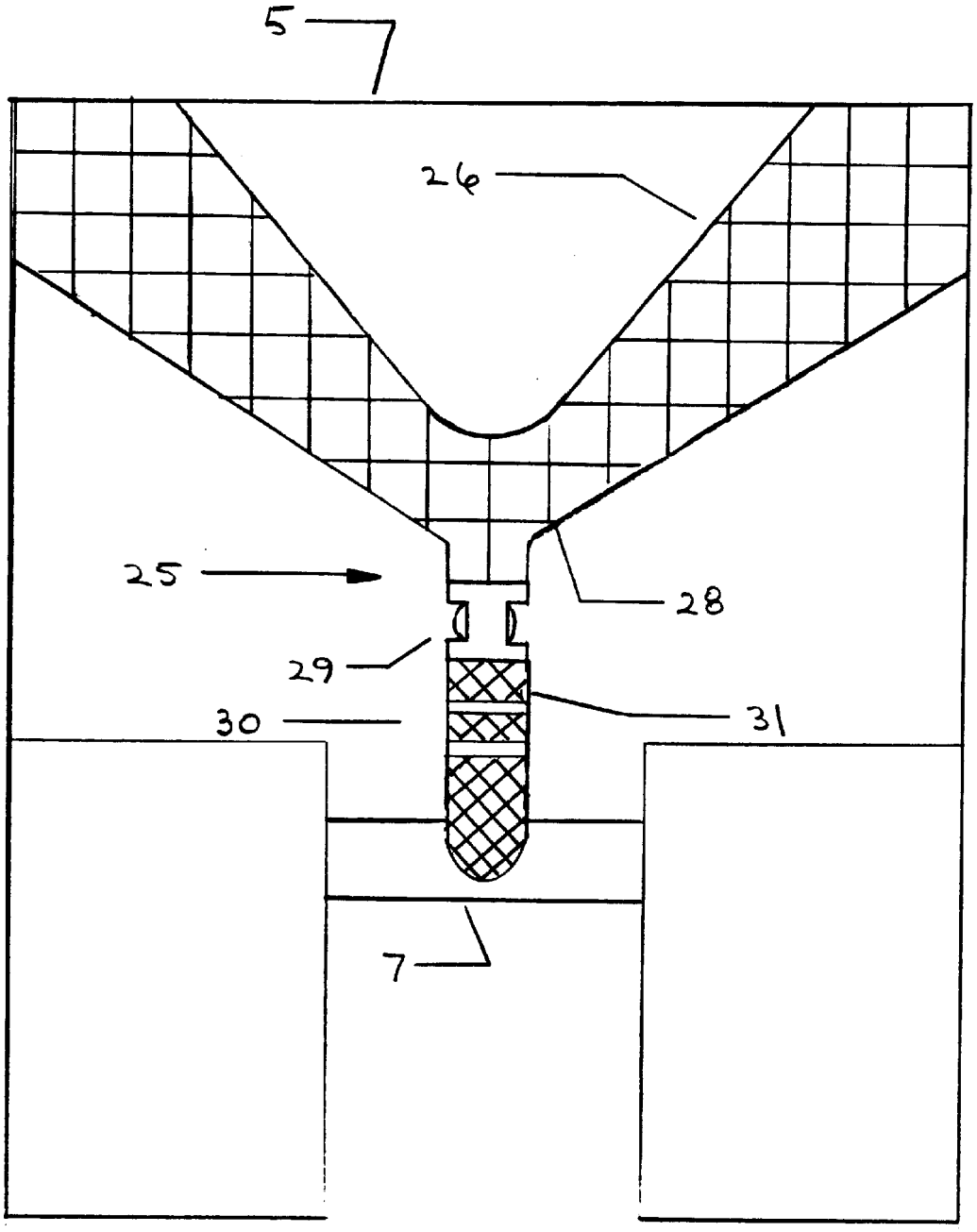
FIG. 12 is a frontal view showing the arrangement of the child support strapping.

The child harness assembly 25 is shown in FIG. 12. The upper component 26 of the child harness assembly is constructed in a U-shape so as to fit comfortably over the shoulders and upper body of the child 27 and is fastened to the upper corners of upper half member 5. The upper component is constructed of a layer of foam padding (not shown) which is entirely contained by a sewn envelope of woven nylon 28. The male part of buckle 29 is connected to the bottom portion of the upper component by means of a sew joint The lower component 30 of child harness assembly 25 is comprised of woven nylon strap 31 and the female part of buckle 29. The lower component is connected at its one end to lateral member 7 and at its opposite end is looped through the female part of buckle 29 so as to make the assembly length adjustable.

Figure 13:
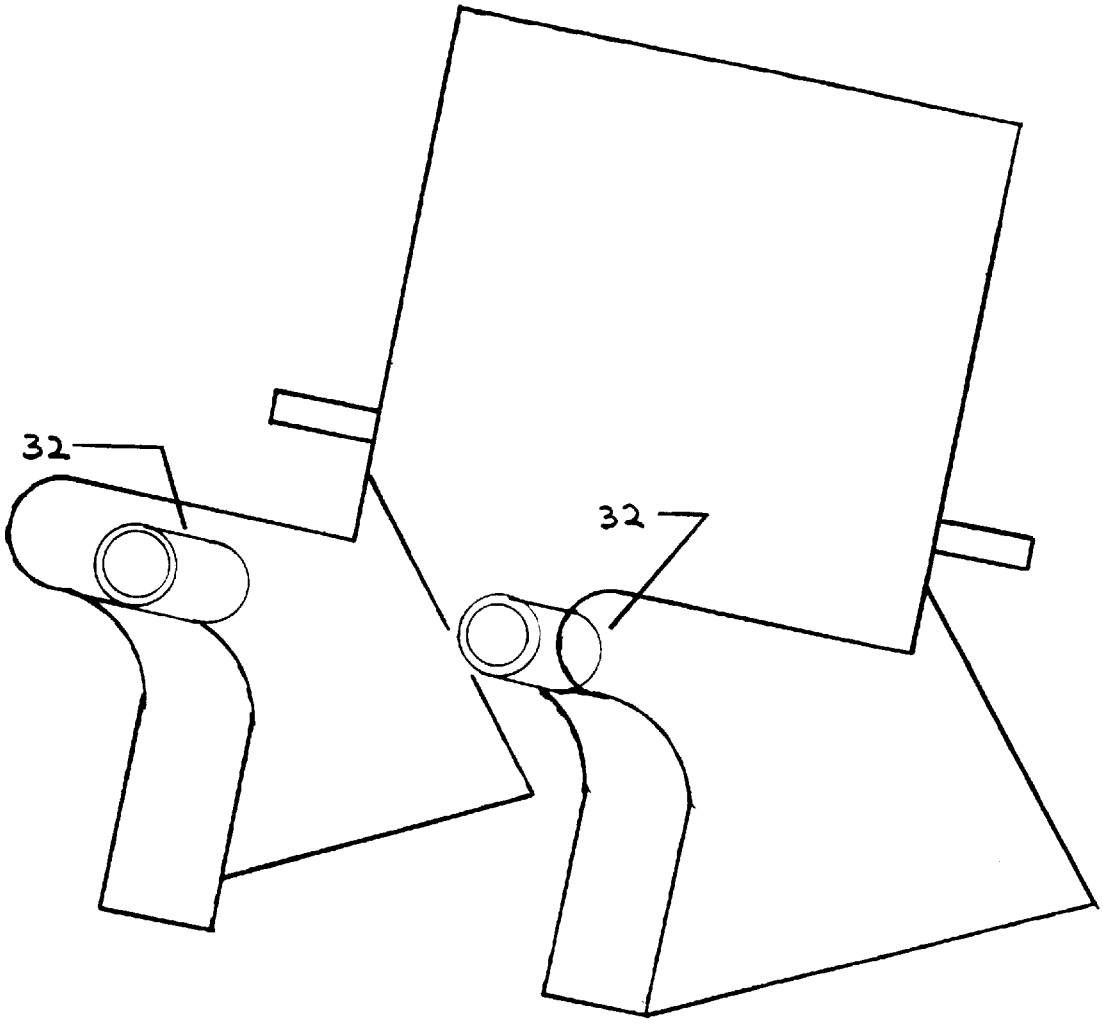
FIG. 13 is a frontal isometric view showing the arrangement of the leg cuffs.
Figure 14:
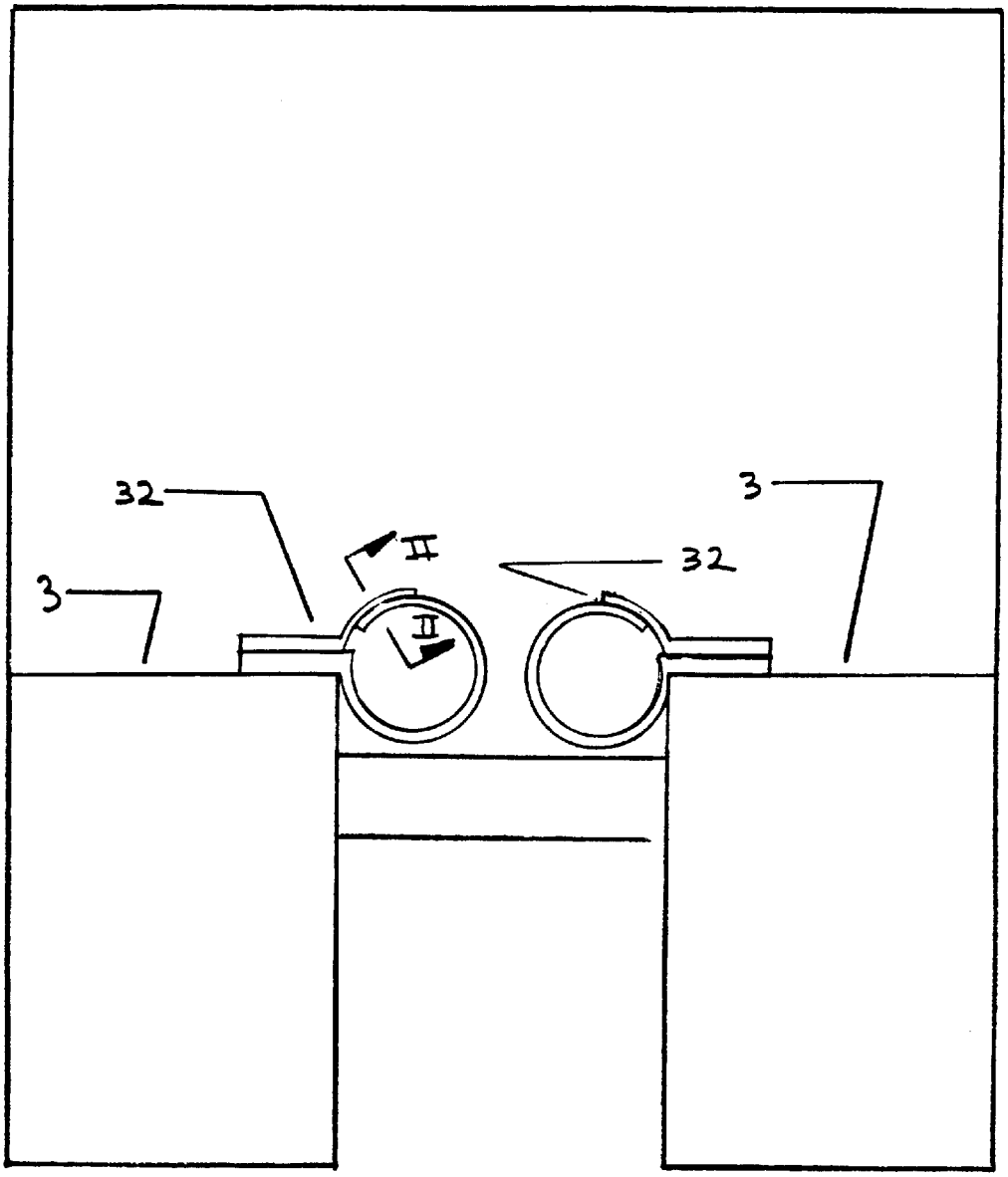
FIG. 14 is a frontal view showing the arrangement of the leg cuffs.
Figure 15:
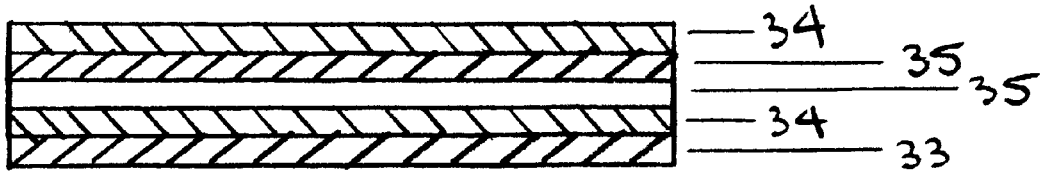
FIG. 15 is a cross sectional view detailing the construction of the leg cuffs.

The ankle cuffs 32 shown in FIGS. 13 and 14 are affixed to the sewn envelopes 14 at the upper forward end of the shoulder mounts. Their purpose is to separate the legs of the child so that they do not impare the ease of mounting the carrying device upon the shoulders of the carrier. The cuffs are not necessary for securing the child and may be unfastened once the carrying device is secured to the adult. As detailed in FIG. 15, cross sectional view II—II shows the ankle cuffs comprising a layer of woven cotton 33, or other similar material comfortable to the bare legs of a child, an outside layer of woven nylon 34 and mating layers of hook and loop fastener 35 for ease of assembly and disassembly.

Figure 16:
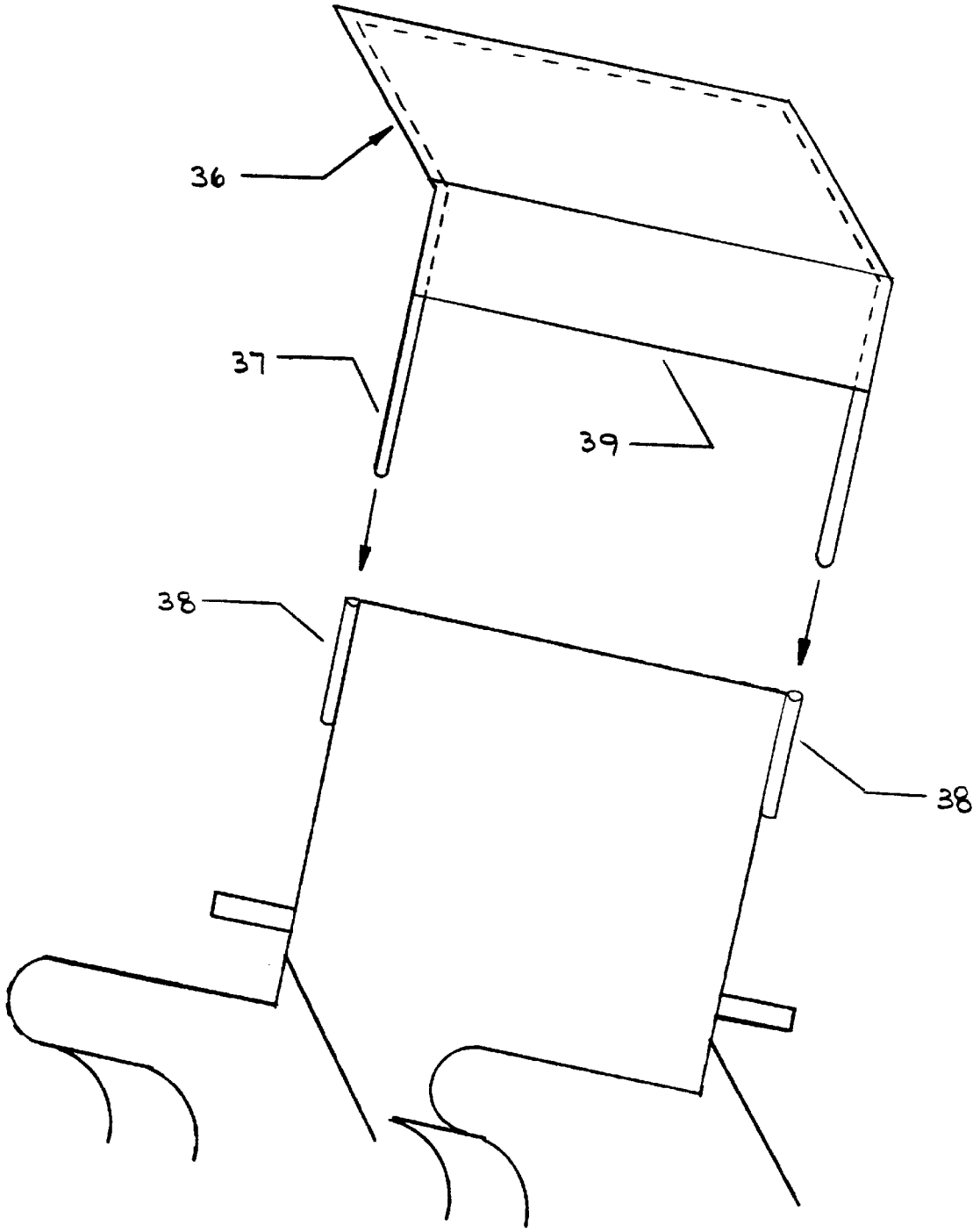
FIG. 16 is a frontal isometric view showing the rain hood.

FIG. 16 shows an optional rain hood 36 which is comprised of an aluminum tubing framework 37 and woven cloth canopy 39. The framework is made from a single tube which is bent firstly into a "U" shape and then bent symmetrically at about the middle of the "U" 90 degrees. The distance between either of the ends of the framework are dimensioned so that they may slide into the mating mounting tubes 38 which are closed at the bottom end and on their sides connected to the upper half member 5. The canopy 39 of the rain hood is made from double layers of woven nylon which are sewn into an open ended pocket and slipped over and about the framework.

A set of optional accessory bags (not shown) may be usefully attached to the bottom half side members 6.

In operation, the child 27 is placed into the carrying device 1 and child harness assembly 25 is placed about the child, buckle 29 connected and strap 31 adjusted until snug. The carrier 4 then loops the chest harness assemblies 20 up and over the handles 11, grasps the carrying device by the handles, hoists the carrying device up and over the head and settles it down onto the shoulders. The chest harness assembly 20 is wrapped across the chest and buckle 21 is fastened; then the buckles 19 of shoulder harness assemblies 18 and the chest harness assembly are connected. The chest harness and shoulder harness can then be adjusted until the fit is snug. To remove the carrying device the chest harness buckles 21 and shoulder harness buckles 19 are unfastened, the chest harness assemblies are pulled back, up and over the handles, the carrying device is lifted up and over the head, then placed down to the front of carrier.

Figure 18:
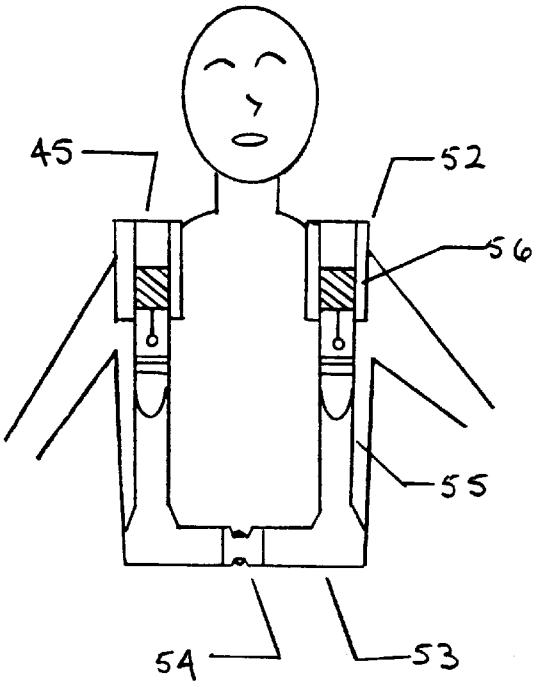
FIG. 18 is a frontal view of the separate harness assembly.
Figure 19:
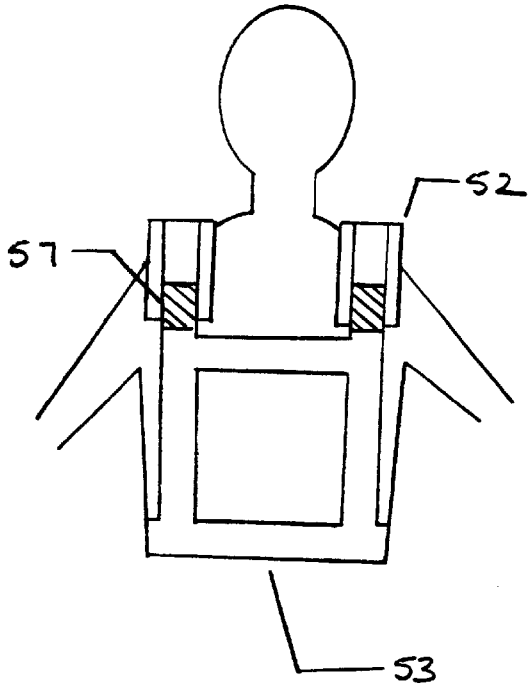
FIG. 19 is a rearward view of the separate harness assembly.
Figure 20:
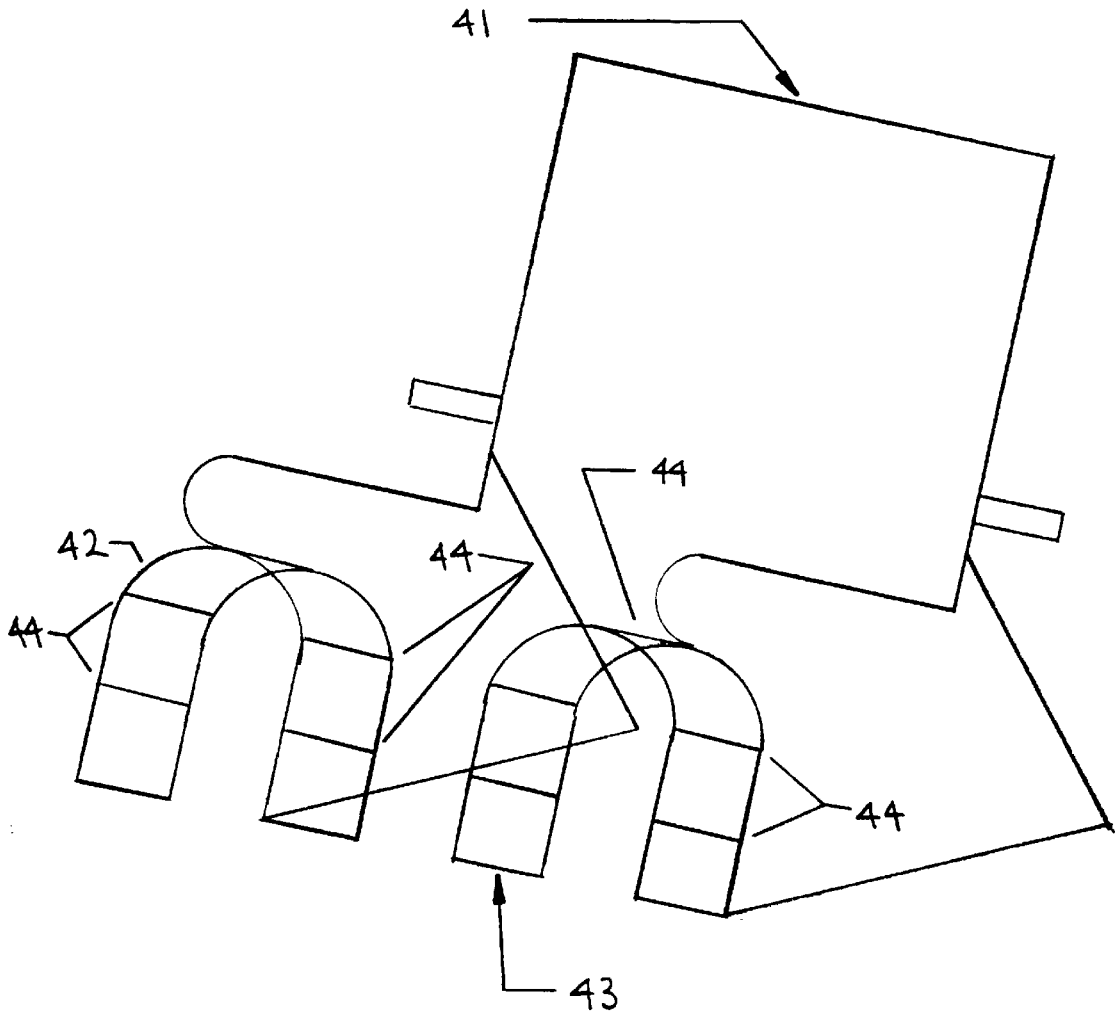
FIG. 20 is a frontal isometric view of the carrier framework and shows the tubular structure of the shoulder mounts extended so that they may fit into the harness cradles.

FIGS. 17 through 24 illustrate the carrying device and its support harness as two separate assemblies. The separate carrying device 40 is of similar construction to that of carrying device 1 except that there are no chest harness assemblies 20, no shoulder harness assemblies 18 and no collar 15. As shown in FIG. 20, the framework 41 of the separate carrying device 40 is similar to the framework 2 of carrying device 1 except that the shoulder mount plates 3 are replaced by shoulder mount tubing 42. The shoulder mount tubing is comprised of shoulder tubing structure 43 which is laid out in the same geometry as the shoulder mount plates 3 except that the forward and rearward portions are further extended a short distance; and cross members 44 which reinforce the shoulder tubing structure at five places each side.

Figure 17:
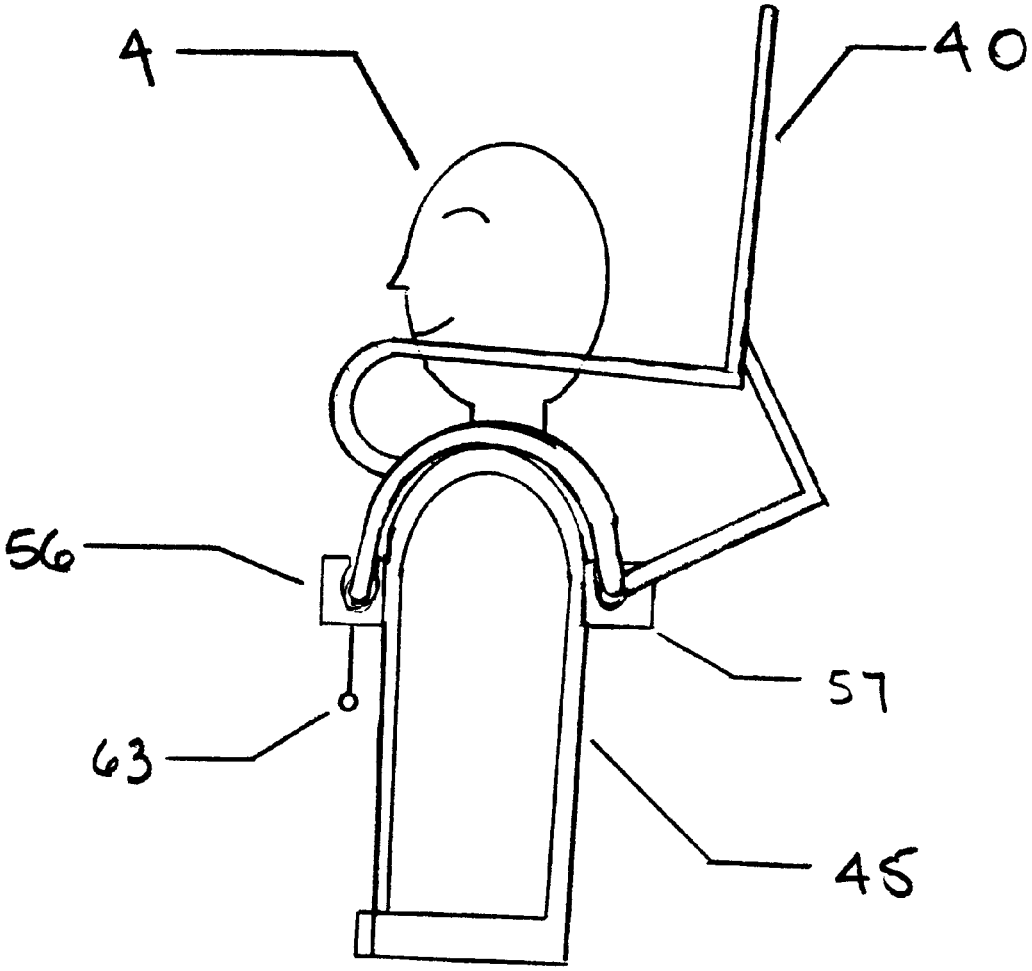
FIG. 17 is a side view showing the carrying device and its harness assembly as separate constructions.
Figure 21:
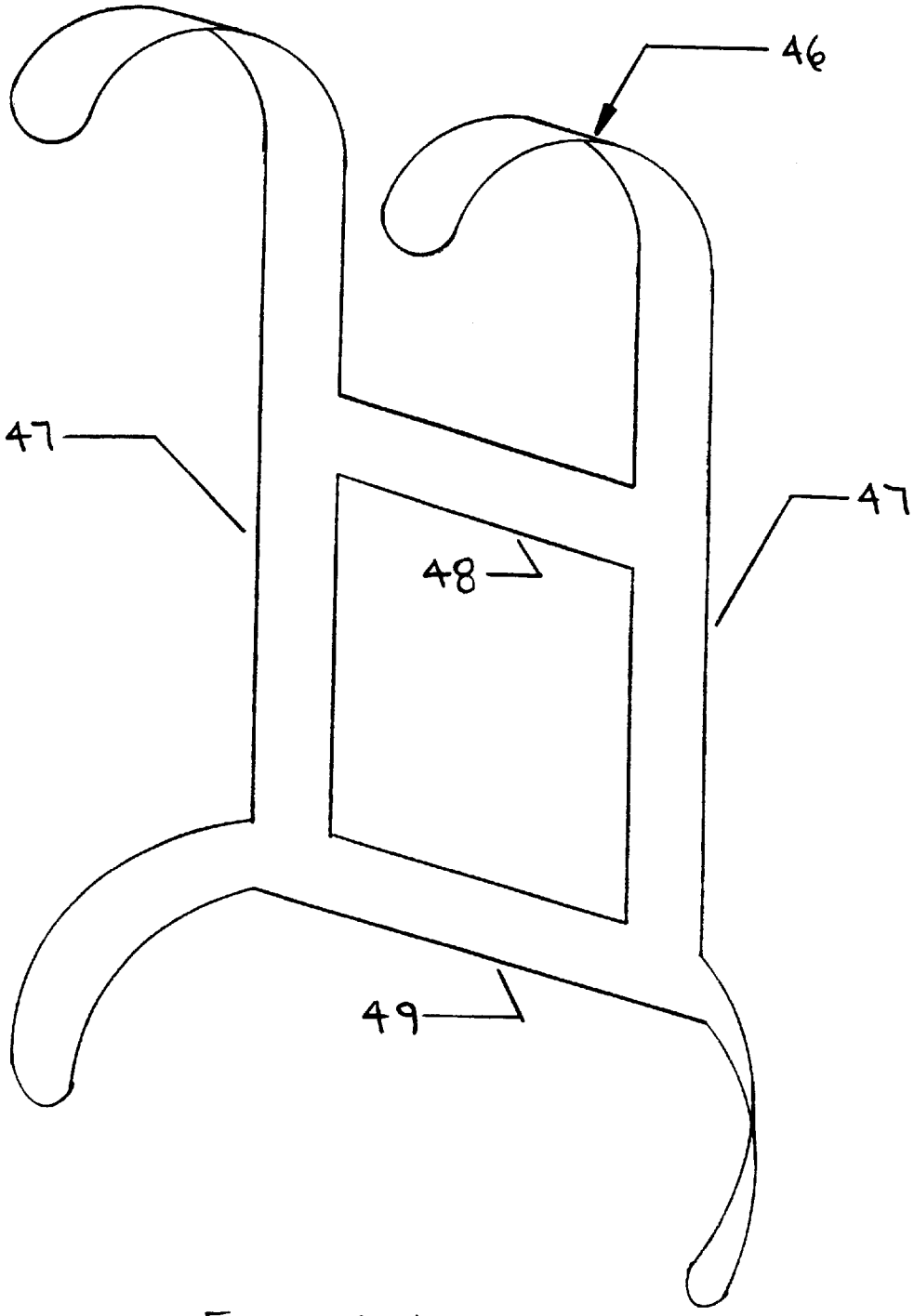
FIG. 21 is a frontal isometric view showing the structural framework of the separate harness assembly.

The separate harness assembly 45 is as shown in FIGS. 17, 18 and 19. The structural framework 46 of the separate harness assembly is shown in FIG. 21 and is comprised of rectangular sections cut from aluminum or thermoplastic sheet. The two vertical members 47 are connected to the two lateral members 48 and 49 or alternately, the entire structure may be cut or molded from the same sheet of material. The upper portion of the two vertical members 47 are bent forwards to fit the shoulders of the carrier and both ends of the lower lateral member 49 are bent forwards to fit the waist of the carrier. A foam padding liner 50 is affixed to the inside of the structural framework and both liner and framework are enclosed in a sewn woven nylon envelope 51. The foam padding liner 50 widens at the shoulders to form the shoulder pads 52.

The belt 53 is made from woven nylon and is affixed to the lower lateral member 49. Both ends of the belt are looped through the male and female parts respectively of buckle 54 so as to make it length adjustable. A pair of length adjustable shoulder straps 55 are affixed at their one end to the upper forward portion of the envelope 51 and at their other end to an opposing position on belt 53.

Figure 24:
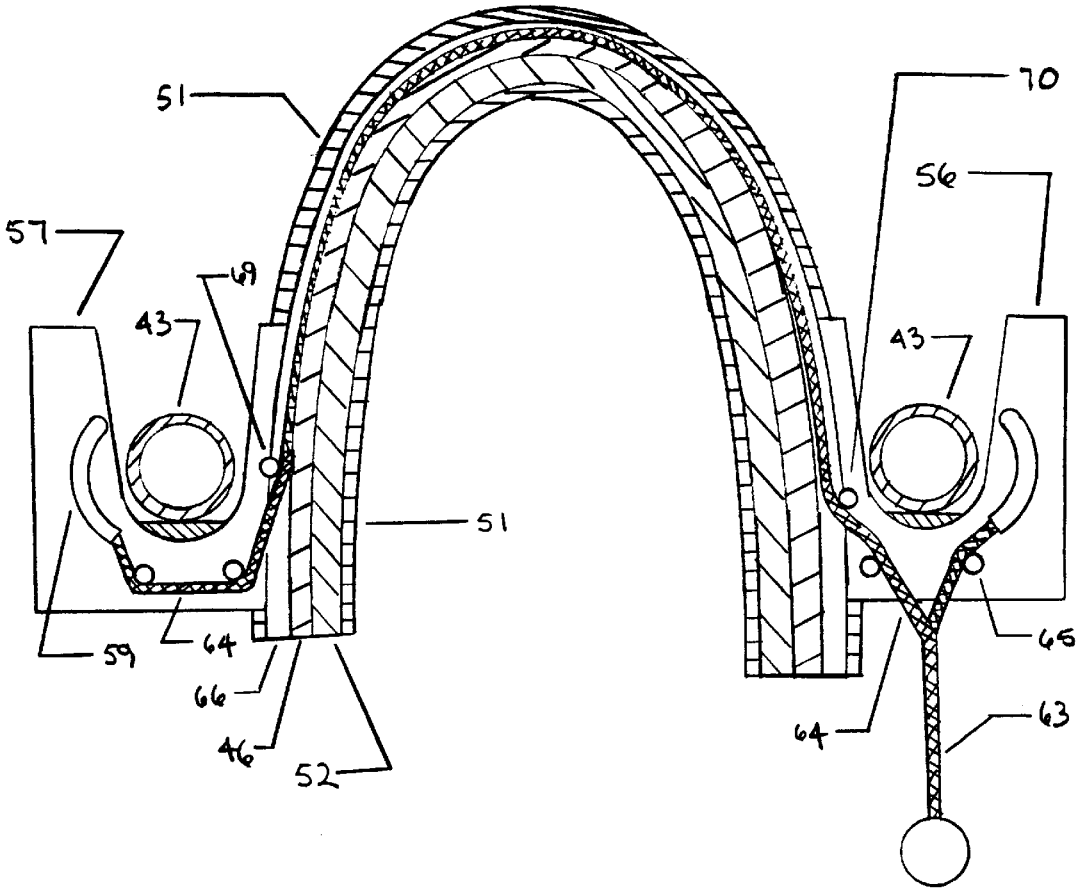
FIG. 24 is a cross sectional view detailing the shoulder portion of the separate harness assembly with cradle locks, drawcords and closed channel.

The cradle locks 56 and 57 as detailed in FIGS. 22 through 24 are fastened to the front and back respectively of the framework 46 at the mating position of the shoulder tubing structure 43 when separate carrying device 40 is mounted. As detailed in FIGS. 22 and 23, cradle locks 56 and 57 are each comprised of a cradle 58, spring loaded lock pin 59, spring loaded trigger 60, spring loaded lock catch 61, spring loaded trigger actuator 62; and drawcords 63 and 64 respectively. Components 58 through 62 may be constructed of any suitable structural material such as aluminum, drawcords 63 and 64 are constructed of woven nylon.

As shown in FIG. 24 the drawcords 63 pass over bearings 65 and hang down from the forward mounted cradles 56 so that they are easily accessible to the carrier. The drawcords 64 of the rearward cradles 57 change direction through the bearings 69, pass through channels 66 which are situated within the upper portion of the framwork 41, then pass through the bearings 70 of the forward mounted cradles 56 where they are connected to drawcords 63 so that both may be drawn concurrently.

Figure 22A:
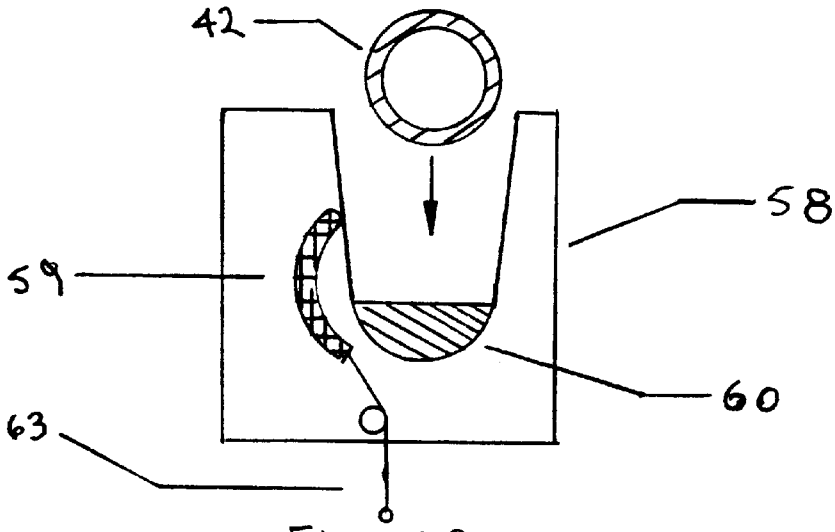
FIGS. 22*a*, 22*b* and 22*c* show a schematic which details the operating principal of the cradle lock.
Figure 22B:
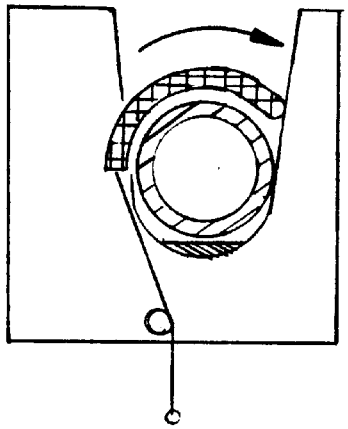
Figure 22C:
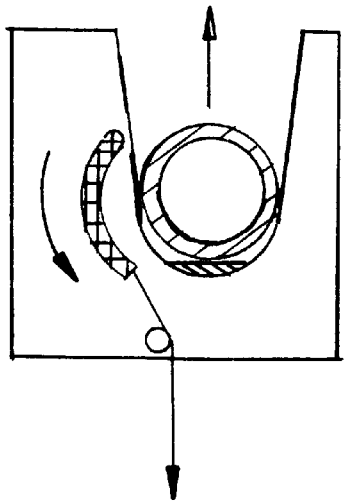
Figure 23A:
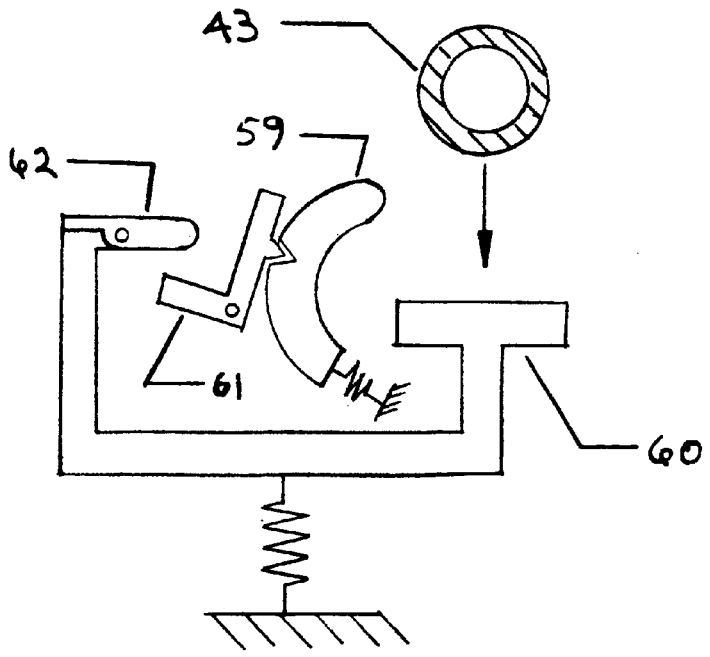
FIGS. 23*a* through 23*f* are schematics which further details the spring and catch mechanisms of the cradle lock.
Figure 23B:
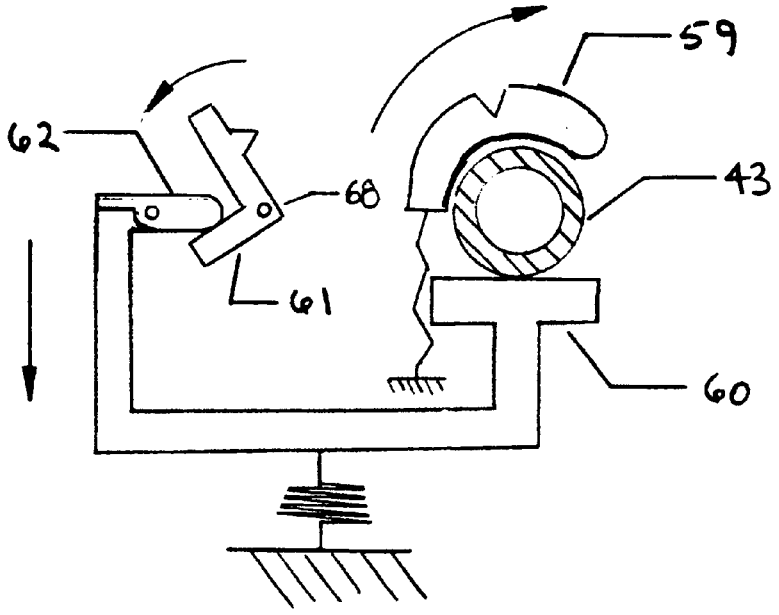
Figure 23C:
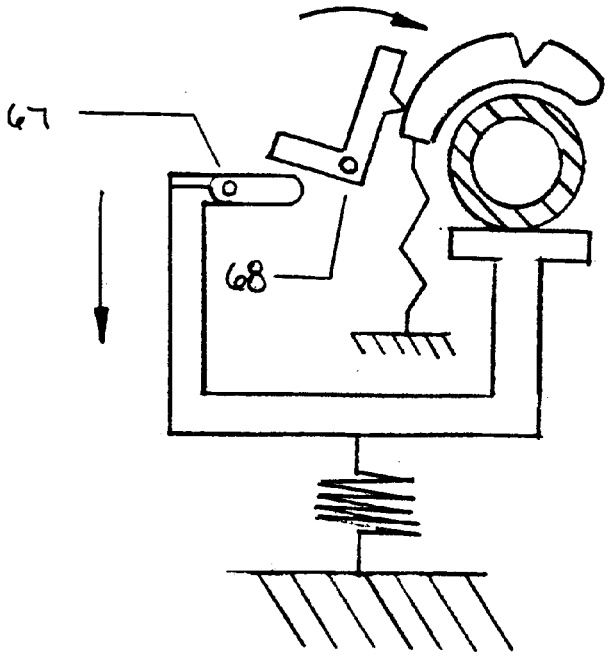
Figure 23D:
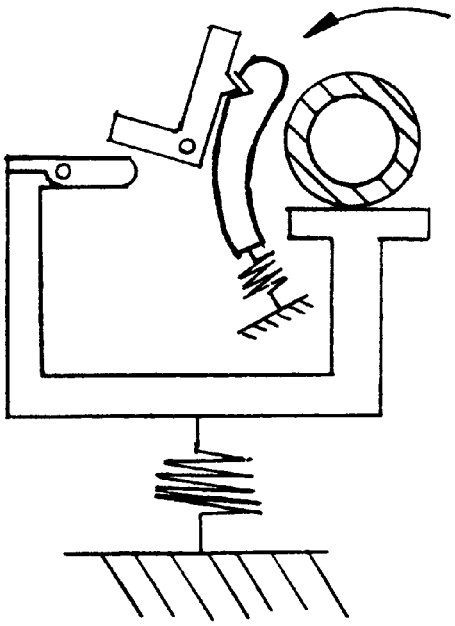
Figure 23E:
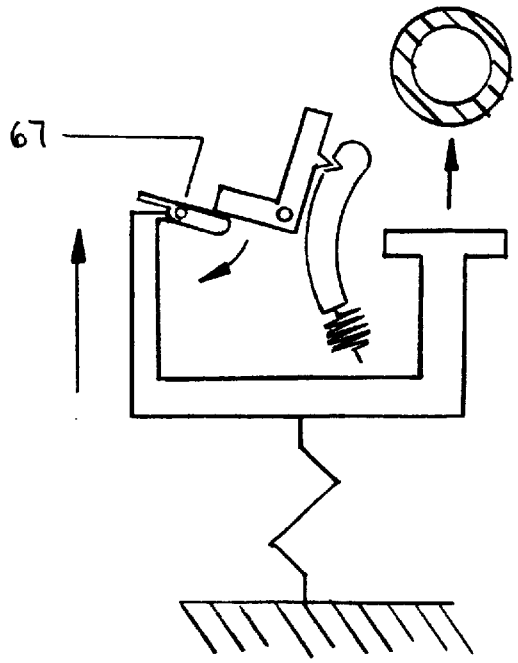
Figure 23F:
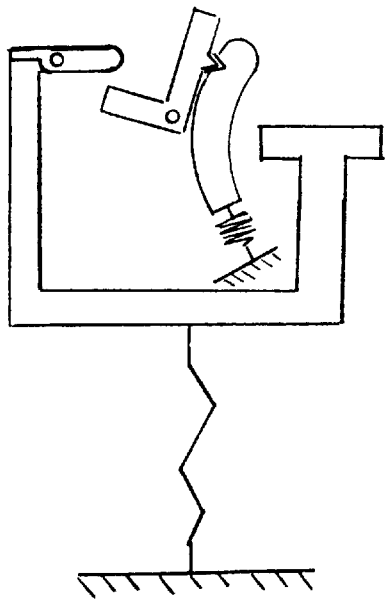

The general operating principal of the cradle locks is shown in FIG. 22. FIG. 22*a* shows the spring loaded lock pin 59 drawn away from the cradle lock entrance, shoulder tubing structure 43 of the separate carrying device 40 entering the cradle lock and the spring loaded trigger 60 in the relaxed position. FIG. 22*b* shows the shoulder tubing structure in place and at rest in the cradle lock, the trigger pressed down by the weight of the separate carrying device, and the lock pin unloaded and in place to secure the tubing structure and the carrying device. FIG. 22*c* shows the lock pin drawn back by means of force applied through the drawcord, allowing the carrying device to be lifted out of the cradle.

Further details of the concept are shown in FIG. 23. These details are meant to further illustrate, but not limit to any particular mechanism, the operating principals of the cradle lock. FIG. 23*a* further details FIG. 22*a* and shows the lock pin 59 fully retracted and its spring compressed. The lock pin is secured by spring loaded lock catch 61. FIG. 23*b* further details FIG. 22*b* and shows the shoulder tubing structure 43 of the separate carrying device 40 pressed down into the cradle by its own weight, thus forcing the trigger 60 downwards which causes the trigger actuator 62 to engage the lock catch 61. The lock catch rotates on its pivot bearing 68 away from the lock pin 59 which is then forced into position over the shoulder tubing structure by its unloading spring. As shown in FIG. 23*c* the trigger and its actuator, when fully pushed into place by the weight of the carrying device, bypass the lock catch which is then released and by the action of its unloading spring rotated until it comes into contact with the lock pin. FIG. 23*d* further details FIG. 22*c* and shows the lock pin pulled down and away from the shoulder tubing structure by its drawcord. The lock catch is held in contact with the smooth shank of the lock pin by the force of its spring until its tooth mates with the grooved notch of the lock pin, thus fixing the lock pin in place. Once all four of the cradle locks have their lock pins drawn back and fixed by their lock catches the carrying device is free to be lifted out of the separate harness assembly. FIG. 23*e* further details FIG. 22*c* and shows the shoulder tubing structure of the separate carrying device being lifted away from the cradle, thus unloading the trigger and allowing it freedom to move upward. The trigger actuator contacts the lock catch and rotates on its pivot bearing 67 down and away, thus allowing the trigger to pass by and over the lock catch. FIG. 23*f* shows the cradle empty and the trigger assembly in place to be reloaded with the separate carrying device.

In operation, the child 27 is set into the separate carrying device 40 and child harness assembly 25 is placed about the child, the buckle 29 connected and strap 31 adjusted until snug. The carrier 4 dons the separate harness assembly 45, connects the buckle 54 and adjusts the shoulder straps 55 and belt 53 until snug. The carrier then grasps the separate carrying device 40 by the handles 11, hoists it up and over the head, and places it onto the shoulders where the shoulder tubing structure 43 locks into the cradles 56 and 57. To dismount the separate carrying device, the carrier grasps onto one of the handles and pulls one set of the drawcords 63 and 64, reverses hands and repeats the process on the other side, then hoists the separate carrying device off the shoulders and over the head, and places it down to the front.

The foregoing description of the preferred embodiment of the invention has been presented for the purposes of illustration and description. It is not intended to be exhaustive or to limit the invention to the precise form disclosed. Many modificatons and variations are possible in light of the above teaching. For example, the retaining harness assembly shown as a three point restraint system may with equal effect also be a four point restraint system or a five point restraint system. The components made from aluminum could also be made from any suitable structural material such as steel, thermoplastic or composite layup. The components made from woven nylon could also be made from any other suitable kind of woven cloth, or in the case of the seat/seat back, also molded in thermoplastic or composite layup. It is intended that the scope of the invention be limited not by this detailed description, but rather by the claims appended hereto.

We claim:

1. A shoulder mounted carrying device into which a child or other person may be securely strapped and which is structured so that it may be, without assistance from a second person, hoisted from the front of the carrier to the carrier's shoulders to situate a child or other person behind the head of the carrier, and be secured to the carrier by a system of belts, straps, and buckles, said carrying device comprising;

a frame made from suitable rigid structural materials, the frame comprising a pair of shoulder mounts of which the forward portion is formed into an arc so as to fit comfortably onto the shoulders of the carrier and a rigid bracing member which is affixed to the shoulder mounts and fashioned so as to provide support for a seat and seat back;

a seat and seat back to be made from suitably strong flexible materials and affixed to the frame;

grab handles connected to the frame to facilitate the handling of the carrying device;

a first system of length-adjustable belts, straps and buckles to secure the carrying device to the carrier;

and a second system of length-adjustable belts, straps and buckles to secure the child to the carrying device.

2. The carrying device according to claim 1 wherein said structural members, shoulder mounts, transverse members, seat and seat back are comprised of molded thermoplastic or composite layup.

3. The carrying device according to claim 1 comprising:

an upper half member which is symmetric about the halfway point and which is connected to forward outside corners of the shoulder mounts, said half portions then being symmetrically formed in a semicircular fashion to continue rearwardly, symmetrically bent to continue upwardly, and bent in opposing angles so as to form the upper portion of the back rest;

a pair of bottom half side members which are connected to rearward outside corners of the shoulder mount plates to project rearwardly and which are then bent upward to connect to the upper half members;

a transverse member which connects the pair of symmetrically opposed bottom half side members at their upper portion and a transverse member which connects the upper portion of the shoulder mounts;

foam padding attached to the upper and under side of the shoulder mounts and enclosed by an envelope of suitably strong flexible material;

said seat and seat back of suitably strong flexible material is affixed on one end to the upper transverse portion of the upper half member and on the opposite end to the forward transverse member;

reinforcing cross straps sewn to the bottom of the woven cloth seat and secured on the one end to the transverse portion of the upper half member and on the other to the forward transverse member;

said handles connected to the carrying device at the loaded center of gravity;

said first system comprising a first set of length-adjustable belts and buckles connected to the bottom portion of the shoulder mounts and passing under the arms of the carrier to be fastened across the chest of the carrier and a second set of length-adjustable belts and buckles connected to the upper portion of the shoulder mounts and fastened to mating buckles on the aforementioned first set of length adjustable belts and buckles.

4. The carrying device according 3 claim wherein the transverse structural members are hinged at their centers and extremities to permit the collapse of the carrying device for easy stowage.

5. The carrying device according to clam 3 wherein leg cuffs are mounted to the top portion of the shoulder mounts so that the child's legs may be secured by them in an out of the way position as the carrying device is mounted onto the shoulders of the carrier.

6. The carrying device according to claim 3 wherein a rain/sun hood and accessory pouches may be optionally attached.

7. The carrying device according to claim 3 wherein the belts and buckles required to secure the device to the carrier are fashioned as a harness assembly separate from the carrying device, said carrying device having shoulder mounts made from tubing and said separate harness assembly comprising a frame, an interior layer of foam padding, an envelope of woven cloth enclosing the frame and foam padding, a length adjustable belt, a pair of length adjustable shoulder straps attached on one end to the shoulders of the harness assembly and passing to the front of the carrier to where they are connected on the other end to the front of the belt, and two sets of cradle locks, each set being affixed to the forward and rearward upper portions of the separate harness assembly and positioned so that the forward and rearward portions of the shoulder mount tubing of the carrying device fit snugly into the cradle locks when the carrying device is mounted upon the carrier's shoulders;

said cradle locks being equipped with spring loaded pins that close automatically over the forward and rearward portions of the shoulder mount tubing as the carrying device is mounted upon the shoulders of the carrier;

and said pins being equipped with draw cords and locking mechanisms so that they may be drawn back and locked out of the way to allow the carrying device to be removed from the shoulders of the carrier.

* * * * *